US010818238B2

(12) United States Patent
Shan

(10) Patent No.: US 10,818,238 B2
(45) Date of Patent: Oct. 27, 2020

(54) VOLTAGE SAMPLING CIRCUIT, METHOD, AND DISPLAY APPARATUS

(71) Applicants: Chengdu BOE Optoelectronics Technology Co., Ltd., Chengdu, Sichuan (CN); BOE Technology Group Co., Ltd., Beijing (CN)

(72) Inventor: Dongxiao Shan, Beijing (CN)

(73) Assignees: Chengdu BOE Optoelectronics Technology Co., Ltd., Chengdu, Sichuan (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/332,285

(22) PCT Filed: Aug. 7, 2018

(86) PCT No.: PCT/CN2018/099128
§ 371 (c)(1),
(2) Date: Mar. 11, 2019

(87) PCT Pub. No.: WO2019/114291
PCT Pub. Date: Jun. 20, 2019

(65) Prior Publication Data

US 2019/0355306 A1 Nov. 21, 2019

(30) Foreign Application Priority Data

Dec. 14, 2017 (CN) ..... 2017 1 1340005

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01)

(58) Field of Classification Search
CPC ..... G09G 3/30–3291; G09G 3/36–3696
See application file for complete search history.

(56) References Cited

U.S. PATENT DOCUMENTS 6,069,605 A 5/2000 Ozawa
2005/0128170 A1* 6/2005 Kang ..... G09G 3/20 345/87

(Continued)

FOREIGN PATENT DOCUMENTS

CN 1138904 A 12/1996
CN 101930705 A 12/2010

(Continued)

OTHER PUBLICATIONS

International Search Report & Written Opinion dated Oct. 29, 2018, regarding PCT/CN2018/099128.

(Continued)

*Primary Examiner* — Hang Lin
(74) *Attorney, Agent, or Firm* — Intellectual Valley Law, P.C.

(57) ABSTRACT

The present application discloses sampling circuit for voltage compensation in a display apparatus. The sampling circuit includes multiple sampling sub-circuits. Each of the multiple sampling sub-circuits includes an output terminal coupled to a voltage collection port, a control terminal coupled to at least one gate-driving output terminal of a gate-driver-on-array (GOA) circuit for driving the display apparatus, and an input terminal coupled separately to a respective one of a plurality of voltage sampling points in the display apparatus. Each sampling sub-circuit is configured to collect, a voltage signal at the input terminal and transfer the voltage signal via the output terminal to the voltage collection port when the gate-driving output terminal outputs a gate-driving signal.

13 Claims, 8 Drawing Sheets

(56) References Cited

U.S. PATENT DOCUMENTS

| | | | | |
|---|---|---|---|---|
| 2013/0016083 | A1 | 1/2013 | Maekawa et al. | |
| 2013/0038516 | A1 | 2/2013 | Chuang et al. | |
| 2015/0194105 | A1 | 7/2015 | Han et al. | |
| 2015/0207492 | A1 | 7/2015 | Duan et al. | |
| 2015/0348488 | A1 | 12/2015 | Wu | |
| 2016/0013777 | A1 | 1/2016 | Duan et al. | |
| 2016/0284275 | A1* | 9/2016 | Aflatooni | H03M 1/72 |
| 2017/0004764 | A1 | 1/2017 | Kim et al. | |
| 2017/0004765 | A1* | 1/2017 | Tani | G09G 3/3275 |
| 2017/0061865 | A1* | 3/2017 | Park | G09G 3/325 |
| 2018/0308430 | A1 | 10/2018 | Xu | |

FOREIGN PATENT DOCUMENTS

| | | | |
|---|---|---|---|
| CN | 102598097 | A | 7/2012 |
| CN | 102930810 | A | 2/2013 |
| CN | 103700334 | A | 4/2014 |
| CN | 103714773 | A | 4/2014 |
| CN | 103714774 | A | 4/2014 |
| CN | 104036743 | A | 9/2014 |
| CN | 106328062 | A | 1/2017 |
| CN | 107016964 | A | 8/2017 |
| JP | 2007156127 | A | 6/2007 |

OTHER PUBLICATIONS

First Office Action in the Chinese Patent Application No. 201711340005.9, dated May 28, 2019; English translation attached.

Second Office Action in the Chinese Patent Application No. 201711340005.9, dated Feb. 26, 2020; English translation attached.

* cited by examiner

VOLTAGE SAMPLING CIRCUIT, METHOD, AND DISPLAY APPARATUS

CROSS-REFERENCE TO RELATED APPLICATION

This application is a national stage application under 35 U.S.C. § 371 of International Application No. PCT/CN2018/099128, filed Aug. 07, 2018, which claims priority to Chinese Patent Application No. 201711340005.9, filed Dec. 14, 2017, the contents of which are incorporated by reference in the entirety.

TECHNICAL FIELD

The present invention relates to display technology, more particularly, to a voltage sampling circuit, a method, and a display apparatus having the same.

BACKGROUND

As display technology advances, organic light-emitting diode (OLED) has become one widely used as a current-driven light-emitting device in many high performance display panel due to runny advantageous characteristics including self luminance, fast response time, wide viewing angles. In the OLED display panel, each pixel includes an OLED device and a pixel driving circuit to drive light emission of the OLED. The OLED device has an anode, an organic light emission layer, and a cathode. The pixel driving circuit can be connected to the anode of the OLED device to provide an anode-driving voltage thereof. However, this anode-driving voltage and other node voltages in the pixel driving circuit are easily interfered to become unstable, thereby affecting display quality of the OLED display panel.

SUMMARY

In an aspect, the present disclosure provides a sampling circuit for voltage compensation in a display apparatus. The sampling circuit includes multiple sampling sub-circuits. Each of the multiple sampling sub-circuits includes an output terminal coupled to a voltage collection port, a control terminal coupled to at least one gate-driving output terminal of a gate-driver-on-array (GOA) circuit for driving the display apparatus, and an input terminal coupled separately to a respective one of a plurality of voltage sampling points in the display apparatus. Each sampling sub-circuit is configured to collect a voltage signal at the input terminal and transfer the voltage signal via the output terminal to the voltage collection port when the gate-driving output terminal outputs a gate-driving signal.

Optionally, the respective one of the plurality of voltage sampling points is in a region of a respective one of a plurality of pixels of the display apparatus. The respective one of the plurality of voltage sampling points is driven by the gate-driving signal from the gate-driving output terminal of the GOA circuit.

Optionally, the display apparatus is an organic light-emitting diode display and the plurality of voltage sampling points are anodes of a plurality of light-emitting diodes in a plurality of pixels.

Optionally, the sampling circuit further includes a voltage-retaining sub-circuit having a first terminal coupled to the output terminal of each of the multiple sampling sub-circuits, a second terminal coupled to the voltage collection port. The voltage-retaining sub-circuit is configured, during a current sampling period when no voltage signal is outputted from the output terminal of each of the multiple sampling sub-circuits, to retain a voltage level at the voltage collection port same as the voltage signal transferred to the voltage collection port in a last sampling period.

Optionally, each sampling sub-circuit includes a first transistor having a gate electrode coupled to a gate-driving output terminal of the GOA circuit, a first electrode coupled to a voltage sampling point, and a second electrode coupled to the voltage collection port.

Optionally, the voltage-retaining sub-circuit includes a capacitor coupled with a switch. The switch has a control terminal coupled to a clock signal terminal, an input terminal coupled to the output terminal of each of the multiple sampling sub-circuits, and an output terminal coupled to a first terminal of the capacitor and the voltage collection port. The capacitor has a second terminal coupled to a pull-down power supply terminal. The switch is configured to control a connection of the output terminal of each of the multiple sampling sub-circuits to the voltage collection port when a clock control signal provided at the clock signal terminal is an effective turn-on voltage level. Or the switch is configured to control a disconnection of the output terminal of each of the multiple sampling sub-circuits to the voltage collection port when a clock signal provided at the clock signal terminal is an effective turn-off voltage level.

Optionally, the voltage-retaining sub-circuit further includes a first impedance converter having a first terminal coupled the output terminal of each of the multiple sampling sub-circuits and a second terminal coupled to the input terminal of the switch.

Optionally, the voltage-retaining sub-circuit further includes a second impedance converter having a first terminal coupled to the output terminal of the switch and a second terminal coupled to the voltage collection port.

Optionally, the voltage-retaining sub-circuit further includes a first impedance converter having a first terminal coupled the output terminal of each of the multiple sampling sub-circuits and a second terminal coupled to the input terminal of the switch. The voltage-retaining sub-circuit further includes a second impedance converter having a first terminal coupled to the output terminal of the switch and a second terminal coupled to the voltage collection port.

Optionally, the sampling circuit described herein further includes a second transistor having a gate electrode coupled to a starting gate-driving output terminal of the GOA circuit, a first electrode coupled to a voltage sampling point in the display apparatus, and a second electrode coupled to the voltage collection port. The starting gate-driving output terminal is configured to output a driving signal before a first gate-driving output terminal of the GOA circuit outputs a first gate-driving signal.

Optionally, in the sampling circuit described herein, a quantity of the multiple sampling sub-circuits is equal to a quantity of gate-driving output terminals in the GOA circuit. Control terminals of the multiple sampling sub-circuits are respectively connected to gate-driving output terminals of the GOA circuit.

Optionally, in the sampling circuit described herein, a quantity of the multiple sampling sub-circuits is smaller than a quantity of gate-driving output terminals in the GOA circuit. The multiple sampling sub-circuits include at least one first sampling sub-circuits. An output terminal of each of the at least one first sampling sub-circuits is connected to multiple gate-driving output terminals of the GOA circuit.

Optionally, the GOA circuit is respectively coupled to a first clock signal terminal and a second clock signal terminal. The GOA circuit is configured to control a timing sequence of each gate-driving output terminal to output a corresponding gate-driving signal under control off first clock signal provided to the first clock signal terminal and a second clock signal provided to the second clock signal terminal. The clock control signal is at an ineffective turn-off voltage level when both the first clock signal and the second clock signal are at an ineffective turn-off voltage level. Alternatively, the clock control signal is at an effective tum-on voltage level when at least one of the first clock signal and the second clock signal is at an effective turn-on voltage level.

In another aspect, the present disclosure provides a method of sampling a voltage from a display apparatus. The method includes using a sampling circuit in multiple sampling periods to collect a voltage signal from the display apparatus. The sampling circuit includes multiple sampling sub-circuits, Each of the multiple sampling sub-circuits includes an output terminal coupled to a voltage collection port, a control terminal coupled to at least one gate-driving output terminal of a gate-driver-on-array (GOA) circuit for driving the display apparatus, and an input terminal coupled separately to a respective one of a plurality of voltage sampling points in the display apparatus. The method further includes outputting a gate-driving signal at the at least one gate-driving output terminal of the GOA circuit in each of the multiple sampling periods. Additionally, the method includes using each of the multiple sampling sub-circuits whose control terminal is connected to the at least one gate-driving output terminal to transfer the voltage signal collected at the input terminal from the respective one of the plurality of voltage sampling points in the display apparatus to the voltage collection port when outputting the gate-driving signal.

Optionally, the method further includes using the sampling circuit in a voltage-retaining period. The sampling circuit further includes a voltage-retaining sub-circuit. The retaining sub-circuit has a first terminal and second terminal, the first terminal being coupled to the output terminal of each of the multiple sampling sub-circuits, and the second terminal being coupled to the voltage collection port. The method further includes outputting no gate-driving signal to any gate-driving output terminal of the GOA circuit in the voltage-retaining period. Furthermore, the method includes using the voltage-retaining sub-circuit to retain the voltage signal at the voltage collection port in the voltage-retaining period to be one collected during a last sampling period.

In yet another aspect, the present disclosure provides a display apparatus. The display apparatus includes a display panel, a gate-driver-on-array (GOA) circuit for driving the display panel, and a sampling circuit described herein. The GOA circuit respectively is connected to each row of pixels in the display panel. The sampling circuit respectively is connected to the GOA circuit and to the display panel. The sampling circuit is configured to transfer a voltage signal collected from the display panel to a voltage collection port.

Optionally, the display apparatus further includes a source driving circuit and a display control circuit. The voltage collection port is set in the display control circuit. The display control circuit respectively is connected to the sampling circuit and to the source driving circuit, and is configured to adjust a gamma correction voltage as an input into the source driving circuit based on the voltage signal transferred to the voltage collection port. The source driving circuit respectively is connected to each column of pixels in the display panel, and is configured to adjust a data signal as an input to the each column of pixels based on the gamma correction voltage.

Optionally, the display control circuit includes an adder sub-circuit and a gamma-correction sub-circuit. The adder sub-circuit is respectively connected to the sampling circuit and the gamma-correction sub-circuit. The adder sub-circuit is configured to perform a first calculation based on a preset first base voltage and the voltage signal at the voltage collection port to obtain a first reference voltage. The adder sub-circuit is further configured to perform a second calculation based on a preset second base voltage and the voltage signal at the voltage collection port to obtain a second reference voltage. The gamma-correction sub-circuit is connected to the source driving circuit. The gamma-correction sub-circuit is configured to perform a third calculation based on the first reference voltage and the second reference voltage to obtain the gamma correction voltage and input the gamma correction voltage to the source driving circuit.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Figure 1:
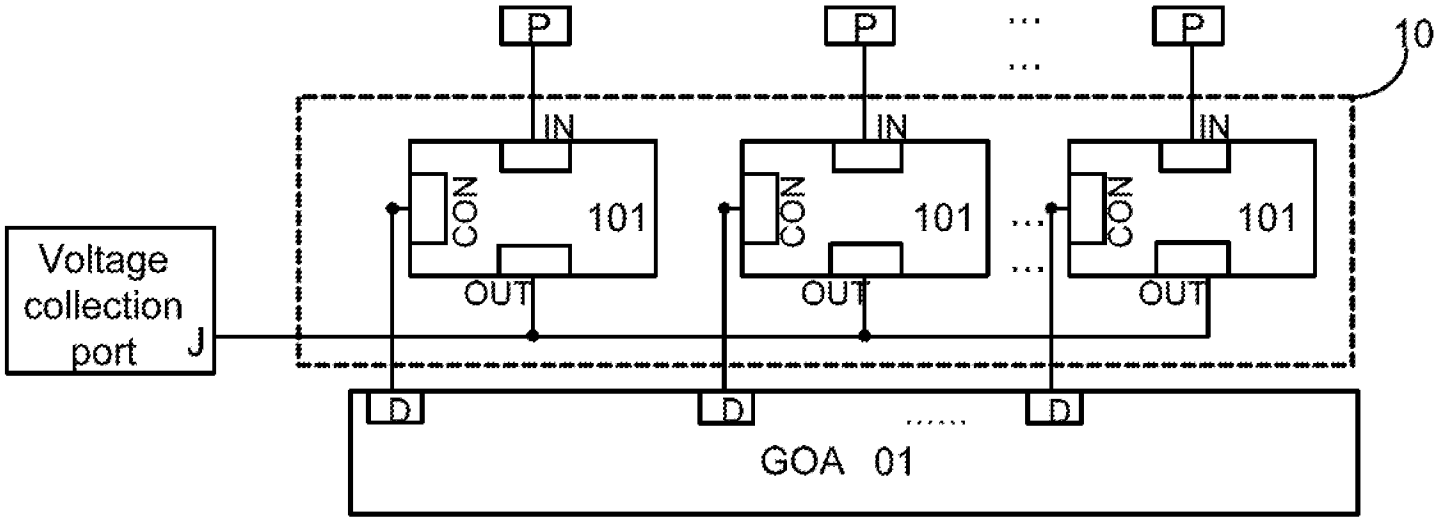
FIG. 1 is a schematic block diagram of a sampling circuit according to some embodiments of the present disclosure.

Accordingly, the present disclosure provides, inter alia, a voltage sampling circuit for supporting a voltage compensation in a display apparatus, a display apparatus having the same, and a method for sampling a voltage signal from a display apparatus thereof that substantially obviate one or more of the problems due to limitations and disadvantages of the related art. In one aspect, the present disclosure provides a sampling circuit for voltage compensation in a display apparatus. FIG. 1 is a schematic block diagram of a sampling circuit according to some embodiments of the present disclosure. Referring to FIG. 1, the sampling circuit 10 includes multiple sampling sub-circuits 101. Optionally, each sampling sub-circuit 101 is configured to be a module having a same circuitry structure.

Referring to FIG. 1, in an embodiment, each sampling sub-circuit 101 includes an output terminal OUT coupled to a voltage collection port J. Each sampling sub-circuit 101 also includes a control terminal CON configured to be connected to at least one gate-driving output terminal D of a gate-driver-on-array (GOA) circuit 01 in the display apparatus. Additionally, each sampling circuit 101 includes an input terminal IN configured to be connected to a voltage sampling point P inside the display apparatus. Each different sampling sub-circuit 101 is connected to a different voltage sampling point P of the display apparatus. The sampling sub-circuit 101 is configured to transfer a voltage signal sampled at the input terminal IN from the voltage sampling point P to the voltage collection port J.

Optionally, the voltage signal sampled or collected by each sampling sub-circuit 101 can be a voltage affecting pixel brightness in the display apparatus. For example, the display apparatus is an organic light-emitting diode (OLED) based display. The voltage signal sampled by the sampling sub-circuit 101 can be a voltage level at an anode of one OLED device. Accordingly, each voltage sampling point P connected by one respective sampling sub-circuit 101 can be on the anode of an OLED device in the display apparatus. In another example, the display apparatus is a liquid crystal display (LCD), the voltage signal sampled by each of the multiple sampling sub-circuits can be a common port voltage of the LCD display apparatus. Accordingly, the voltage sampling point P is located on a common electrode of the LCD display apparatus. In yet another example, the voltage signal sampled by the sampling sub-circuit 101 can also be a voltage of one of several signal lines linked to the display apparatus. Accordingly, the voltage sampling point P can be located at the respective one signal line. Other possibilities of the locations of the voltage sampling point P associated with the display apparatus are also possible.

Figure 2:
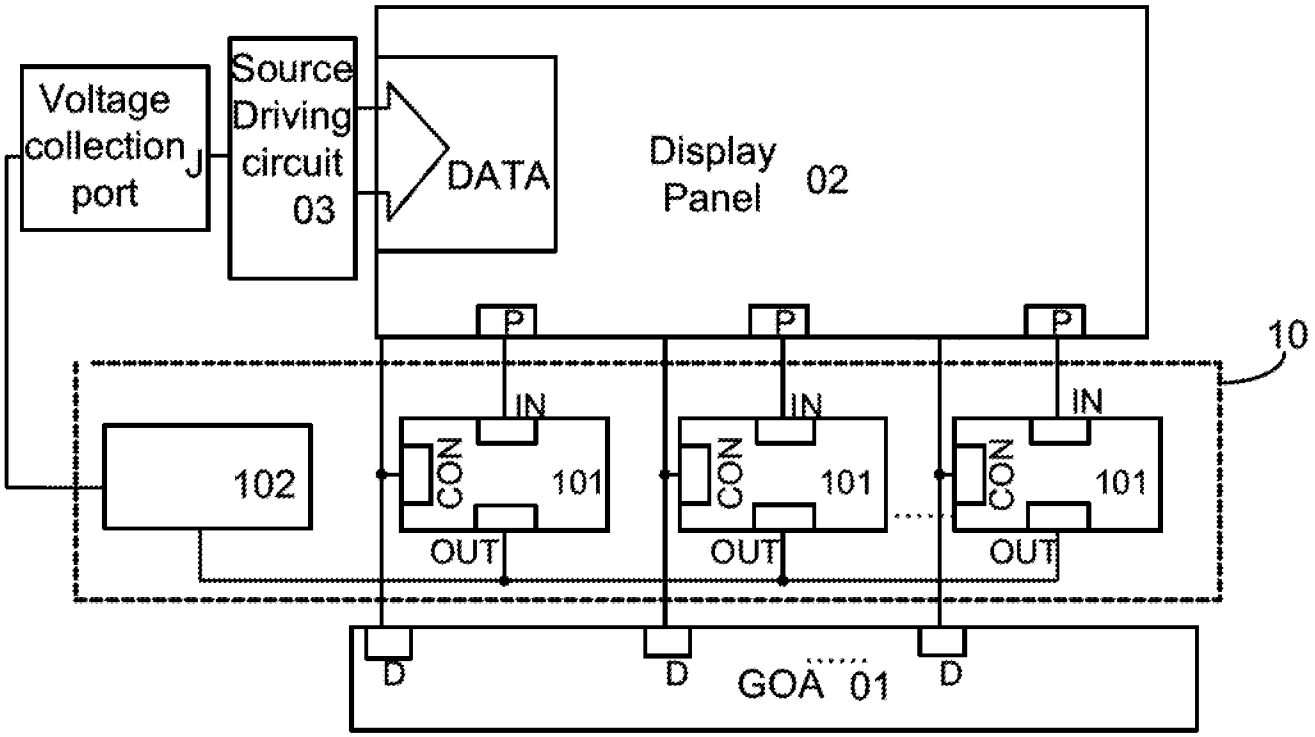
FIG. 2 is a schematic block diagram of a sampling circuit according to some alternative embodiments of the present disclosure.

Optionally, among the multiple sampling sub-circuits 101 of the sampling circuit 10, the voltage sampling point P that is connected by any one sampling sub-circuit 101 can be located in a region of a pixel driven by a gate-driving signal outputted from a respective one of a plurality of gate-driving output terminals connected to the just-mentioned control terminal of the sampling sub-circuit 101. FIG. 2 shows a schematic block diagram of a sampling circuit according to some alternative embodiments of the present disclosure. As shown in FIG. 2, a first sampling sub-circuit 101 is connected to a first gate-driving output terminal D of a GOA circuit 01. The voltage sampling point P connected by the first sampling sub-circuit 101 is located in a region where a first row of pixels is driven by a gate-driving signal outputted from the first gate-driving output terminal D.

Referring to FIG. 2, the display apparatus associated with the sampling circuit 10 also includes a source driving circuit 03. The source driving circuit 03 is configured to be connected to each column of pixels in the display panel 02. When one gate-driving output terminal D connected to one of the multiple sampling sub-circuits 101 outputs a gate-driving signal, the source driving circuit 03 is configured to write a data signal into a row of pixels. Since the voltage sampling point P is located in the region of the row of pixels that is written the data signal, the one of the multiple sampling sub-circuits 101 connected to the voltage sampling point P can accurately collect a voltage signal associated with the row of pixels that is just written the data signal from the source driving circuit 03. Optionally, the collected voltage signal can be a voltage at anodes of OLED devices associated with the row of pixels. Optionally, the voltage signal can be a voltage at a common electrode of the row of pixels.

Referring to FIG. 2 again, each of the multiple sampling sub-circuits 101 includes an input IN coupled to one voltage sampling point P on an anode of the display panel 02. In case the display panel is an OLED display panel, the voltage signal sampled by the sampling sub-circuit 101 is an anode voltage of the OLED display panel.

Referring to FIG. 2, optionally, the sampling circuit 10 also includes a voltage-retaining sub-circuit 102. One terminal of the voltage-retaining sub-circuit 102 is connected to an output terminal OUT of each of the multiple sampling sub-circuits 101. Another terminal of the voltage-retaining sub-circuit 102 may be connected to the voltage collection port J.

In the embodiment, in a current period (e.g., a voltage-retaining period) of time of operating the sampling circuit 10 when none of the multiple sampling sub-circuits 101 outputs any voltage signal to the respective output terminal OUT, the voltage-retaining sub-circuit 102 is configured to maintain the voltage level at the voltage collection port J to be same level collected in last period (e.g., a voltage-collecting period). Optionally, the voltage-retaining sub-circuit 102 is able to store the voltage signal collected in the last (voltage-collecting) period and continues transferring the stored voltage signal to the voltage collection port J during the current (voltage-retaining) period.

In actual application of the GOA circuit to drive a display panel, each individual gate-driving output terminal D of the GOA circuit 01 may not continuously output gate-driving signal. Accordingly, the associated sampling sub-circuit 101 may not be able to output a sampled voltage signal. In this case, the voltage-retaining sub-circuit 102 is able to allow the sampling circuit 10 to still collect a voltage signal even none of sampling sub-circuits 101 outputs any sampled voltage signal, thereby the display performance of the display apparatus can be improved in real time based on the voltage signal.

Referring to FIG. 2, the voltage collection port J can be connected to the source driving circuit 03. The source driving circuit 03 is configured to adjust data signal inputted to each column of pixels of the display panel based on the voltage signal collected at the voltage collection port J. The continuous output of a voltage signal via the voltage-retaining sub-circuit 102 in the sampling circuit 10 can keep the output of the source driving circuit 03 stable to avoid any electromagnetic compatibility (EMC) issue due to discrete voltage signal output.

Figure 3:
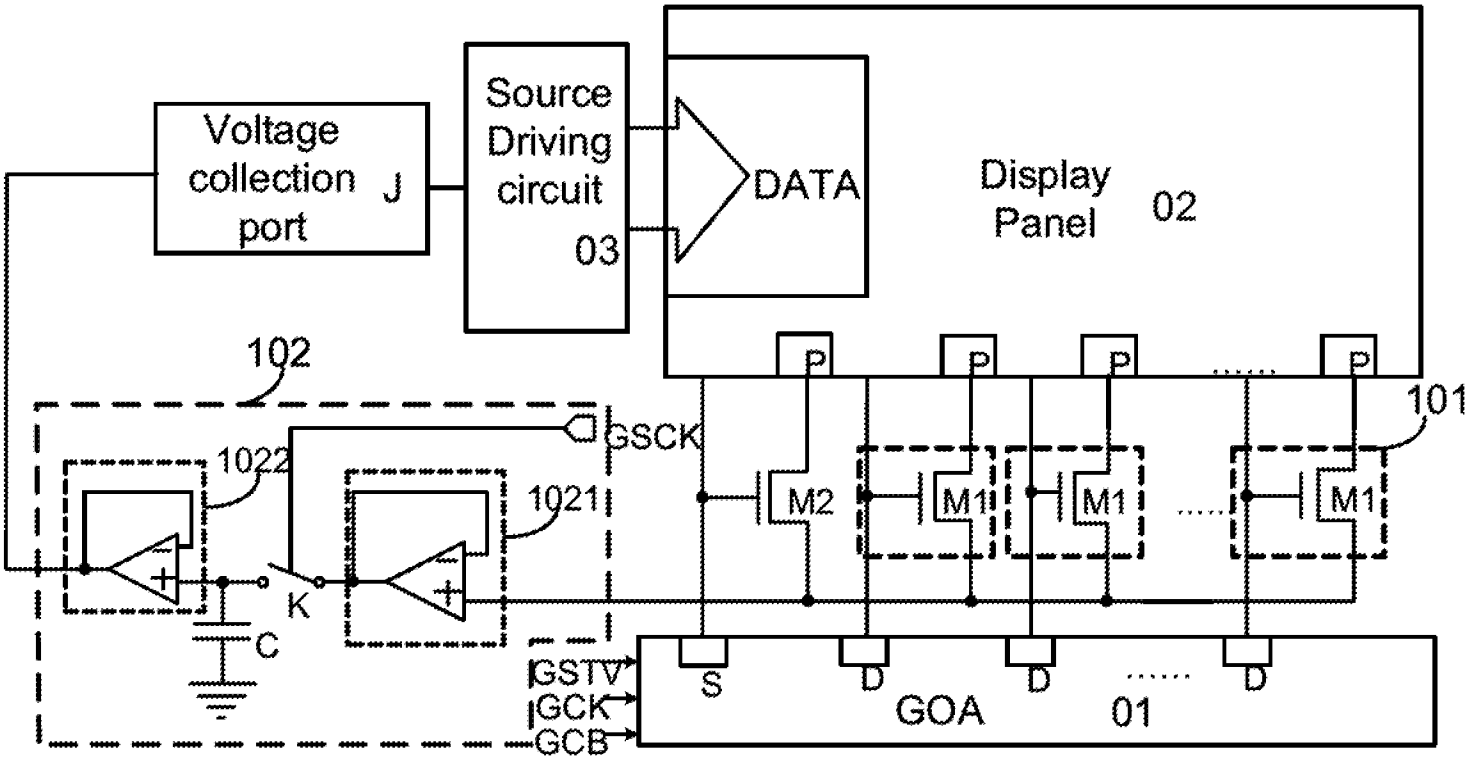
FIG. 3 is a schematic block diagram of a sampling circuit according to additional alternative embodiments of the present disclosure.

FIG. 3 is a schematic block diagram of a sampling circuit according to additional alternative embodiments of the present disclosure. Referring to FIG. 3, each sampling sub-circuit 101 in the sampling circuit includes a first transistor M1. The first transistor M1, or any other transistor employed in the circuit shown in the present disclosure may be a thin-film transistor or a field-effect transistor or other transistor bearing similar physical properties to serve as a switch transistor. A middle terminal of the transistor is a gate electrode, a signal-input terminal is a source electrode, and a signal-output terminal is a drain electrode. Because of a symmetry setting in drain electrode and source electrode of these transistors, the two electrodes are interchangeable. In this application, the source electrode is called a first electrode and the drain electrode is called a second electrode.

Additionally, the switch transistor employed in the present disclosure can include any of a P-type transistor and an N-type transistor. The P-type transistor is in conduction state when the gate electrode is applied with a low voltage level and is closed when the gate electrode is applied with a high voltage level. The N-type transistor is in conduction state when the gate electrode is at the high voltage level and becomes closed when the gate electrode is at the low voltage level.

Referring to FIG. 3, the gate electrode of the first transistor M1 is connected to a gate-driving output terminal D. The first electrode of M1 is connected to a voltage sampling point P in the display apparatus. The second electrode of M1 is connected to the voltage collection port J. In other words, the first transistor M1 of each sampling sub-circuit 101 has the second electrode also severed as an output terminal of the respective sampling sub-circuit 101.

Referring to FIG. 3, when the voltage signal sampled by the sampling sub-circuit is an anode voltage of the OLED display panel, the first electrode of M1 is directly connected to a voltage sampling point P on the anode of the display panel.

Referring to FIG. 1, if no voltage-retaining sub-circuit is not included, the output terminals of the multiple sampling sub-circuits 101 can be connected to a single conduction line which connects to the voltage collection port J. In other words, multiple second electrodes of respective multiple first transistors M1 can be connected directly via a conductor line to the voltage collection port J. Or, referring to FIG. 3, if a voltage-retaining sub-circuit 102 is included in the sampling circuit, the multiple second electrodes of respective multiple first transistors M1 can be connected via the voltage-retaining sub-circuit 102 to the voltage collection port J.

In an embodiment, the voltage-retaining sub-circuit 102 further includes a capacitor C and a switch K. The switch K has a control terminal connected to a clock signal control terminal GSCK, an input terminal connected to the output terminal OUT of each sampling sub-circuit 101, and an output terminal respectively connected to a terminal of the capacitor C and the voltage collection port J. In an embodiment, each sampling sub-circuit 101 includes one first transistor M1, the input terminal of the switch K can be connected to the second electrode of each respective first transistor M1. Optionally, the switch K can be one of switch transistor integrated in the voltage-retaining sub-circuit 102.

Additionally, another terminal of the capacitor C may be connected to a pull-down voltage terminal which provides a stable power supply voltage at a low voltage level (or a turn-on voltage level for P-type transistor or a turn-off voltage level for a N-type transistor). Optionally, the pull-down voltage terminal can be a ground terminal. Referring to FIG. 3, this terminal of the capacitor C is directly grounded.

In an embodiment, when a clock signal control terminal GSCK outputs a clock signal at an effective voltage level (e.g., a low voltage level for turning a P-type transistor o the switch K is to connect the output terminal OUT of each sampling sub-circuit 101 to the voltage collection port J. When the clock signal is at an ineffective voltage level, the switch K controls the output terminal OUT of each sampling sub-circuit 101 to disconnect with the voltage collection port J. The voltage-retaining sub-circuit 102 may output a voltage signal collected in last period to the voltage collection port J so that the GOA circuit 01 is still able to switch and drive a next row of pixels.

In an embodiment, Referring to FIG. 3, the GOA circuit 01 can be connected respectively to an signal-starting terminal GSTV, a first clock signal terminal GCK, and a second clock signal terminal GCB. The GOA circuit 01 can be configured to control output timing of each gate-driving output terminal under controls of a first clock signal outputted by the first clock signal terminal GCK and a second clock signal outputted by the second clock signal terminal GCB. During the operation of the GOA circuit 01, after the signal-starting terminal GSTV outputs an effective driving signal, one of the multiple gate-driving output terminals D of the GOA circuit 01 may output a gate-driving signal to a row of pixels in the display panel whenever any one of the first clock signal and the second clock signal is at the effective voltage level.

When both of the first clock signal and the second clock signal are at the ineffective voltage level, no gate-driving signal is outputted from any gate-driving output terminals D of the GOA circuit 01. At this time, no sampling sub-circuit 101 will output any voltage. Therefore, the clock control signal outputted by the clock signal control terminal GSCK can be an ineffective voltage level at this time so that the switch K in the voltage-retaining sub-circuit 102 can be closed. The voltage-retaining sub-circuit 102, which has used the capacitor C to pre-store a voltage signal collected in a previous period, now can input this pre-stored voltage signal to the voltage collection port J. As seen, when each first transistor M1 in the respective multiple sampling sub-circuits 101 is turned off, the switch K is also closed. This avoids the voltage signal pre-stored in the capacitor C being affected by other voltages through the conductor line with a high resistance load.

When the clock signal control terminal GSCK outputs a clock control signal at the effective voltage level, at least one of the first clock signal and the second clock signal should be at the effective voltage level. Then at this time, at least one of the multiple gate-driving output terminals D of the GOA circuit 01 outputs a gate-driving signal so that the first transistor M1 connected to this at least one output terminal D is turned on and is able to transfer a voltage signal collected at its first electrode via the second electrode to the voltage collection port J.

Figure 4:
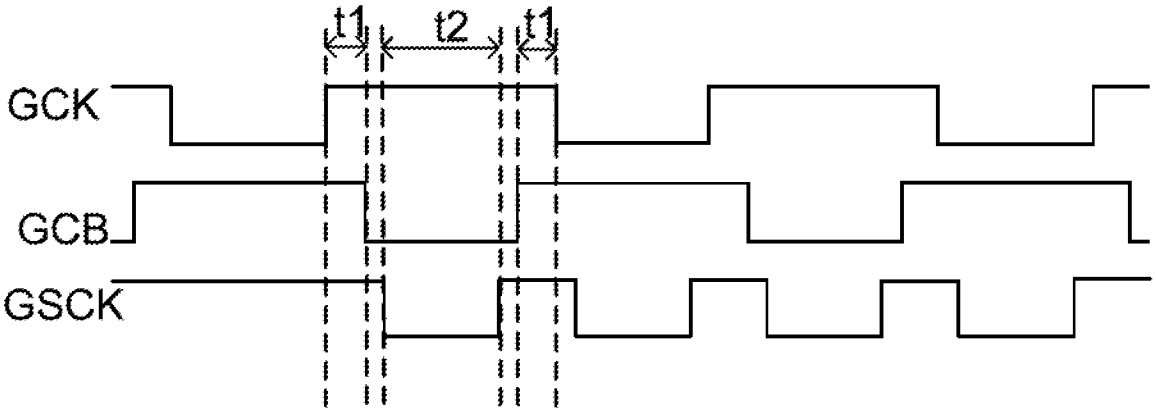
FIG. 4 is a timing diagram of several voltage signals associated with a display apparatus including a sampling circuit according to an embodiment of the present disclosure.

For example, FIG. 4 shows a timing diagram of the clock control signal outputted by the clock signal control terminal GSCK, the first clock signal outputted by the first clock signal terminal GCK, the second clock signal outputted by the second clock signal terminal OCR Assuming that an effective voltage level for the display apparatus is a low voltage level relative to an ineffective voltage level, referring to FIG. 4, the first clock signal and the second clock signal are all at ineffective voltage level in period t1 so that the clock control signal is also at an ineffective voltage level in this period. Alternatively in the period t2, at least one of the first clock signal and the second clock signal is at the effective voltage level so that the clock control signal is also at the effective voltage level in this period.

Optionally, the voltage-retaining sub-circuit 102 includes at least one impedance converter. In an embodiment, the at least one impedance converter includes a first impedance converter 1021 having a first terminal coupled to an output terminal OUT of each sampling sub-circuit 101. Referring to FIG. 3, this terminal of the first impedance converter 1021 is connected to the second electrode of the first transistor M1. A second terminal of the first impedance converter 1021 is connected to the input terminal of the switch K.

In an alternative embodiment, the at least one impedance converter includes a second impedance converter 1022 in addition to the first impedance converter 1021. The second impedance converter 1022 has a first terminal connected to the output terminal of the switch K and a second terminal connected to the voltage collection port J. Optionally, the at least one impedance converter includes a second impedance converter 1022 only.

For example, FIG. 3 shows a voltage-retaining sub-circuit 102 including a first impedance converter 1021 and a second impedance converter 1022. Either impedance converter is provided for eliminating any drop of the voltage signal collected by the sampling sub-circuit 101 through the conduction line connected between the sampling sub-circuit 101 and the voltage-retaining sub-circuit 102, ensuring accuracy of the voltage signal sampled from the display apparatus.

In an embodiment, when the clock control signal outputted by the clock signal control terminal FSCK is an effective voltage signal, the switch K is configured to use the first impedance converter 1021 to transform the voltage signal outputted from the output terminal OUT of each sampling sub-circuit 101 to charge the capacitor C until the voltage signal stored in the capacitor the same as the voltage level at the input terminal IN of the sampling sub-circuit 101, thereby completing the voltage sampling operation. Then, the voltage signal can be inputted to the voltage collection port J by the second impedance converter 1022.

Optionally, each impedance converter can be configured as an operational amplifier. Optionally, each impedance converter can be made by other devices having an impedance conversion function.

Optionally, the sampling circuit also includes a second transistor M2. In an embodiment, the second transistor M2 has a gate electrode coupled to the start-driving output terminal S, a first electrode coupled to a voltage sampling point P in the display apparatus, and a second electrode coupled to the voltage collection port J. For example, for a sampling circuit without setting up a voltage-retaining sub-circuit, the second electrode of the second transistor M2 can be connected via conduction line directly to the voltage collection port J. Or as seen in FIG. 3, for a sampling circuit including a voltage-retaining sub-circuit 102, the second electrode of M2 is connected to the voltage collection port J via the voltage-retaining sub-circuit 102. In particular, the start-driving output terminal S outputs a driving signal ahead of a first gate-driving output terminal D of the GOA circuit so that M2 can sample a voltage signal passed to the voltage collection port J before any other voltage sampling point P is being sampled. This voltage signal set a gray-scale voltage needed for the source driving circuit 03 to drive a first row of pixels in the display panel.

Optionally, as shown in FIG. 3, a number of the multiple sampling sub-circuits 101 can be set to be equal to a number of gate-driving output terminals D of the GOA circuit. In this case, a voltage sampling point P is set within a region of a row of pixels. The control terminal CON of the multiple sampling sub-circuits 101 can be connected, on one-to-one basis, respectively to multiple gate-driving output terminals D of the GOA circuit 01. The input terminal IN of each sampling sub-circuit 101 can be connected to respective one voltage sampling point P. Additionally, the voltage sampling point P connected by a sampling sub-circuit 101 is located within a row of pixels driven by the gate-driving output terminal D that is correspondingly connected to the point P.

When the GOA circuit 01 is configured to drive each row of pixels, the respective sampling sub-circuit 101 can sequentially input a voltage signal corresponding to the row of pixels to the voltage collection port J under control of a gate-driving signal at the gate-driving output terminal D. This voltage signal related to the display apparatus is sampled more accurately under a sampling method according to the present disclosure described herein to improve display performance more effectively.

Alternatively, the number of the multiple sampling sub-circuits 101 can be smaller than the number of the gate-driving output terminals of the GOA circuit 01. In this case, the multiple sampling sub-circuits 101 include at least one (of multiple) first sampling sub-circuit. Each first sampling sub-circuit has a control terminal CON that may be connected with multiple gate-driving output terminals D of the GOA circuit 01 and driven by the gate-driving signals thereof. When any one of multiple gate-driving output terminals D connected to the first sampling sub-circuit outputs a gate-driving signal, the first sampling sub-circuit 101 can transfer a sampled voltage signal to the voltage collection port J. For example, the control terminal CON of each first sampling sub-circuit 101 can be connected to multiple gate-driving output terminals via a control sub-circuit H. The control sub-circuit H can be a multi-input OR gate. Additionally, in order to ensure accuracy of the sampled voltage, it is to ensure that every gate-driving output terminal D connects to a control terminal CON of at least one sampling sub-circuit 101. In other words, gate-driving signal from every gate-driving output terminal D is able to control a control terminal CON of least one sampling sub-circuit 101.

Figure 5:
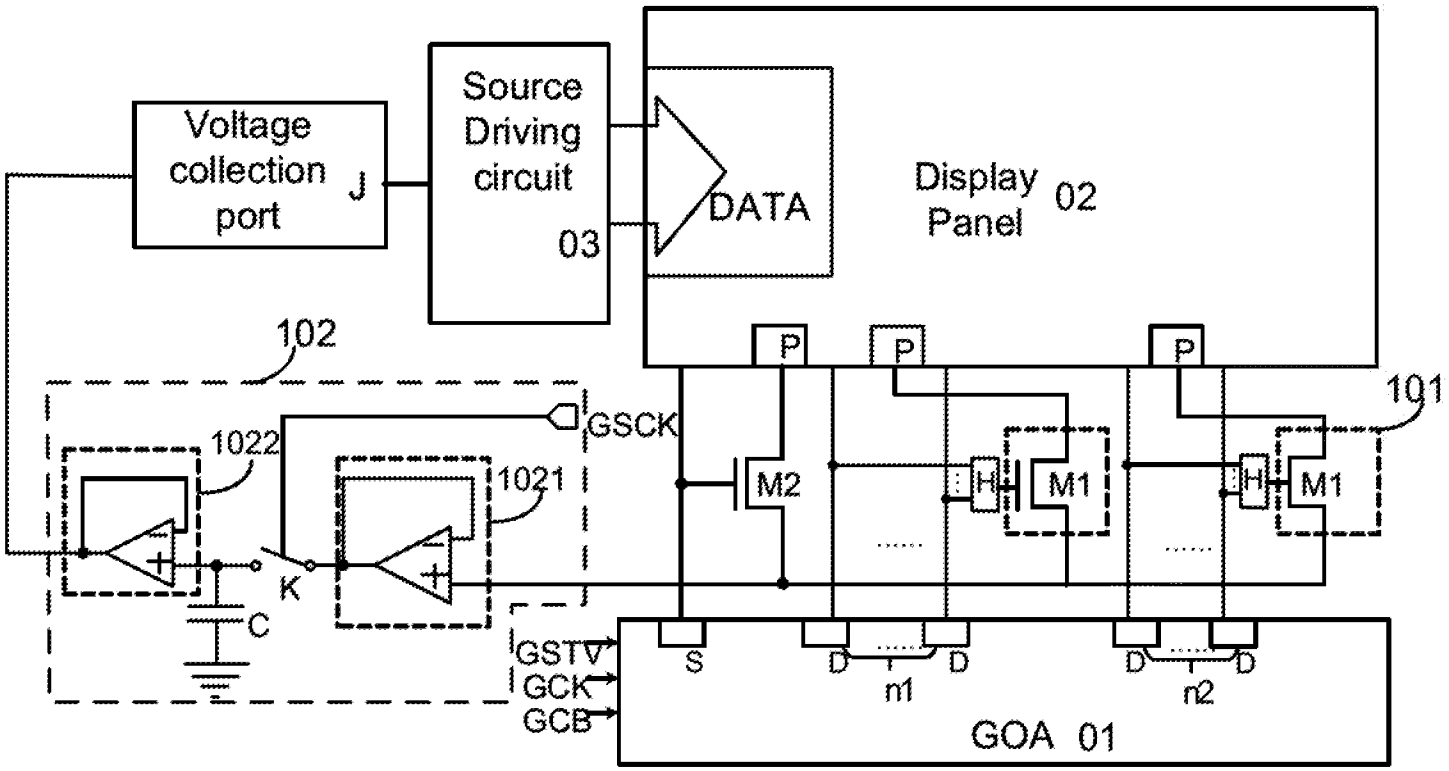
FIG. 5 is a schematic block diagram of a sampling circuit according to yet additional alternative embodiments of the present disclosure.

For example, assuming a display panel 02 has n row of pixels. The GOA circuit 01 includes n gate-driving output terminals D. Each gate-driving output terminal D is to output a gate-driving signal to drive one row of pixels. FIG. 5 is a schematic block diagram of a sampling circuit according to yet additional alternative embodiments of the present disclosure. Referring to FIG. 5, the sampling circuit may include two first sampling sub-circuits 101. In particular, a first one of the two first sampling sub-circuits 101 can connect to first n1 number of gate-driving output terminals D of the GOA circuit 01. A second one of the two first sampling sub-circuits 101 can connect to last n2 number of gate-driving output terminals D of the GOA circuit 01, and here n1+n2=n. Referring to FIG. 5 again, each of the first n1 number of gate-driving output terminals D can be connected with respective one of the n1 rows of pixels and use the respective control sub-circuit H to control a connection with the first one of the two first sampling sub-circuits 101. The control sub-circuit H can drive the first one of the two first sampling sub-circuits based on a gate-driving signal outputted from any one of the n1 gate-driving output terminals D.

In summary, the sampling circuit provided in the present disclosure can include multiple sampling sub-circuits. Each sampling sub-circuit is respectively connected to a voltage collection port, at least one gate-driving output terminal, and a separate voltage sampling point in the display apparatus. Each sampling sub-circuit can transfer the voltage signal sampled thereof to the voltage collection port under control of a gate-driving signal outputted by the gate-driving output terminal. The display apparatus can utilize the sampled voltage signal to improve its display performance.

In another aspect, the present disclosure provides a voltage sampling method. The method is to sample a voltage signal using a sampling circuit described herein and shown in FIG. 1, FIG. 2, FIG. 3, or FIG. 5 for performing voltage compensation in a display apparatus. In an embodiment, the method is executed in multiple sampling periods. In each sampling period, the GOA circuit associated with the display apparatus has one gate-driving output terminal outputting a gate-driving signal to the sampling circuit. Accordingly, the sampling sub-circuit that connects to the corresponding gate-driving output terminal may transfer a voltage signal sampled thereof to the voltage collection port J.

Optionally, the method is executed also in a voltage-retaining period. In the voltage-retaining period, each gate-driving output terminal of the GOA circuit outputs no gate-driving signal. While, a voltage-retaining sub-circuit in each sampling circuit is configured to continue inputting, a voltage signal collected in a last sampling period to the voltage collection port.

In an embodiment, because each gate-driving output terminal of the GOA circuit may not be able to continuously output a gate-driving signal to allow the sampling sub-circuit to keep outputting a sampled voltage signal. In other words, the multiple sampling periods of executing the voltage sampling method may not be executed continuously. Therefore, by setting up a voltage-retaining sub-circuit to store a voltage signal sampled in last sampling period, the sampling circuit is still able to provide a voltage signal to the voltage collection port J even when every gate-driving output terminal of the GOA circuit does not output any gate-driving signal (e.g., it is in the voltage-retaining period). The display apparatus can continuously perform its function to utilize the voltage signal for voltage compensation to improve display performance.

Figure 6:
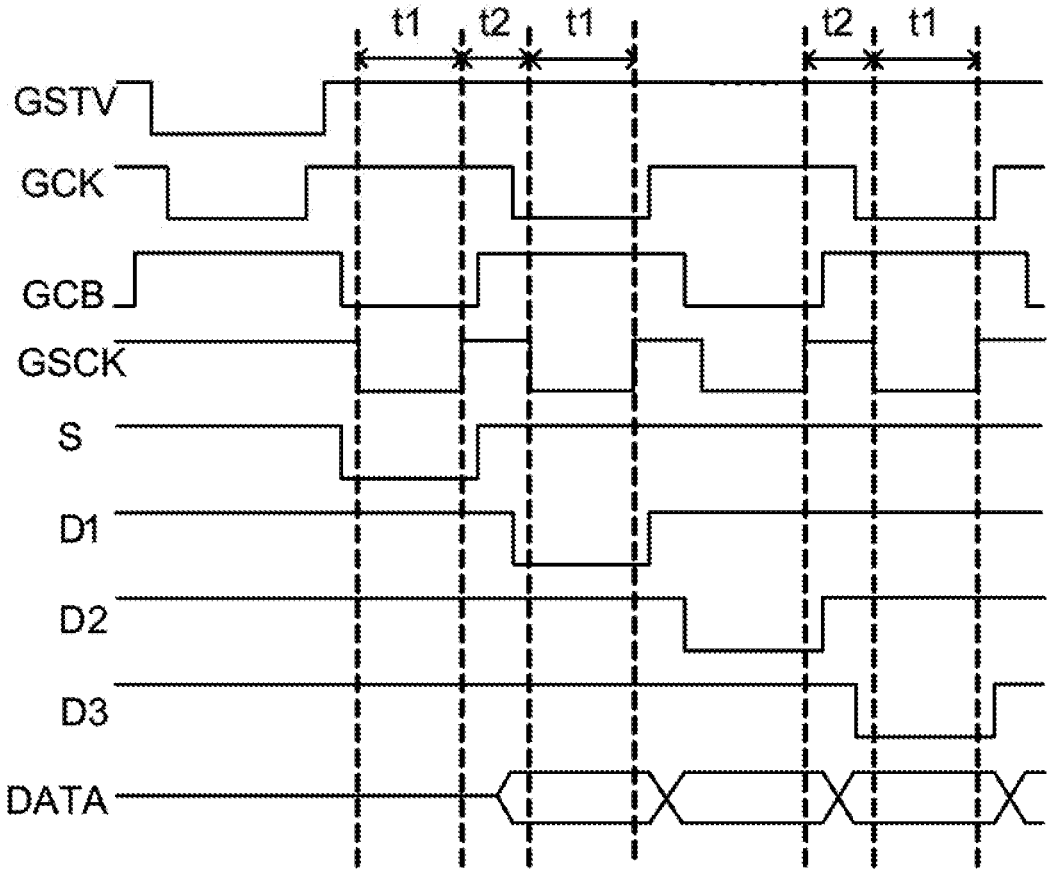
FIG. 6 is a timing diagram of several voltage signals associated with a display apparatus including a sampling circuit according to another embodiment of the present disclosure.

FIG. 6 is a timing diagram of several voltage signals associated with a display apparatus including a sampling circuit according to another embodiment of the present disclosure. Referring to FIG. 6, the sampling circuit is operated to sample voltage signals in multiple sampling periods T1, in which between any two adjacent sampling periods T1 there can be a voltage-retaining period T2. In each sampling period T1, at least one of a first clock signal terminal GCK and a second clock signal terminal GCB outputs a clock signal at an effective voltage level. At this time, the GOA circuit is able to output a gate-driving signal which controls the first transistor M1 to be turned on. Additionally in the sampling period T1, a clock signal control terminal GSCK also outputs a control signal at the effective voltage level to open a switch in the voltage-retaining sub-circuit to connect the sampling sub-circuit to the voltage collection port J, allowing the voltage signal sampled by the sampling sub-circuit to be transferred to the voltage collection port J.

In the voltage-retaining period T2, both the first clock signal terminal GCK and the second clock signal terminal GCB output a clock signal at an ineffective voltage level so that the GOA circuit outputs no gate-driving signal to any gate-driving output terminal. At this time, the first transistor M1 is turned off. Additionally in the voltage-retaining period T2, the dock signal control terminal GSCK also outputs a clock control signal at the ineffective voltage level to close the switch to disconnect the sampling sub-circuit from the voltage collection port J. Then, the voltage-retaining sub-circuit is used to pass a voltage signal stored thereof to the voltage collection port J, where this voltage signal was collected in a last sampling period and pre-stored in the voltage-retaining sub-circuit.

Referring to FIG. 6, the GOA circuit may include a start-driving output terminal S configured to output a driving signal before any gate-driving output terminal D outputs a gate-driving signal. Therefore, when all gate-driving signals are at ineffective voltage level and all the first transistors M1 are not turned on, the start-driving output terminal S outputs a driving signal at an effective voltage level to turn on the second transistor M2. At this time, the clock signal control terminal GSCK outputs a clock control signal at the effective voltage level to turn on the switch in the voltage-retaining sub-circuit. Then, the second transistor M2 is able to transfer a sampled voltage signal to the voltage collection port J via the voltage-retaining sub-circuit even before any sampling sub-circuit is operated to sample any voltage signal.

Additionally, referring to FIG. 6, gate-driving signals D1, D2, D3 out of the gate-driving output terminals D of the GOA circuit can be provided sequentially in time at the effective voltage level. In other words, the multiple first transistors M1 can be turned on sequentially. When D1 is at the effective voltage level, the first one of the multiple first transistors M1 is turned on. At this time, the clock signal control terminal GSCK outputs a clock control signal also at the effective voltage level to turn on switch K. The first transistor M1 now can transfer a voltage signal sampled in the display apparatus to the voltage collection port J. At the same time, a source driving circuit is configured to adjust a data signal based on the voltage signal passed to the voltage collection port J and input the adjusted (or compensated) data voltage to the display apparatus for improving display performance. Note, the example mentioned above is based on P-type transistor being used for both the first transistors M1 and the second transistor M2. Alternative use of N-type transistors needs only to change polarity of each voltage signals in FIG. 6 for executing the method described herein.

Figure 7:
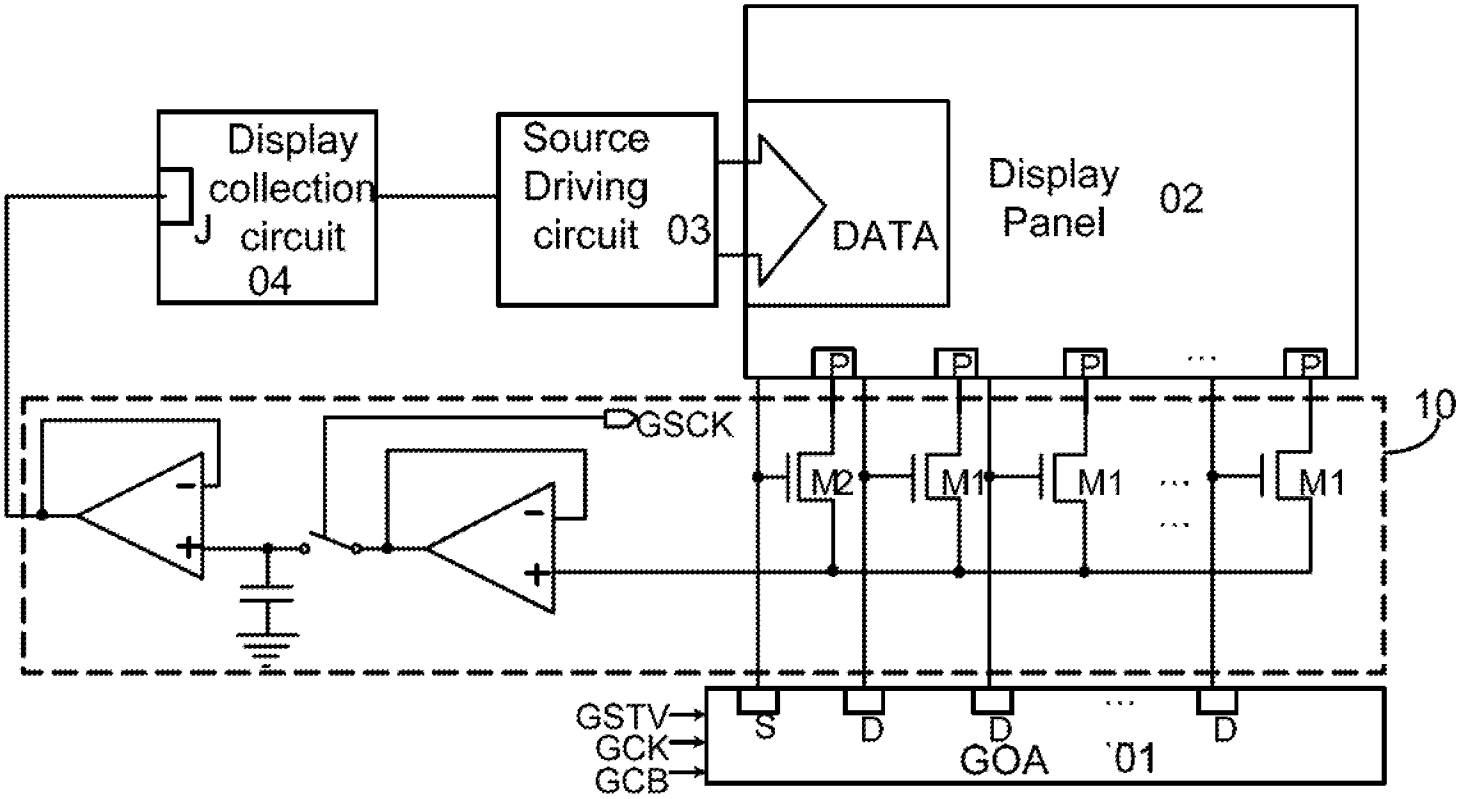
FIG. 7 is a block diagram of a display apparatus according to an embodiment of the present disclosure.

In yet another aspect, the present disclosure provides a display apparatus. FIG. 7 is a block diagram of a display apparatus according to an embodiment of the present disclosure. Referring to FIG. 7, the display apparatus includes a display panel 02, a gate-driver-on-array (GOA) circuit 01 and a sampling circuit 10 as shown in FIG. 1 through FIG. 3 as well as in FIG. 5. In particular, the GOA circuit 01 can be connected respectively with multiple rows of pixels in the display panel 02. The sampling circuit 10 can be connected respectively to the GOA circuit 01 and the display panel 02 and configured to transfer a voltage signal sampled in the display panel to a voltage collection port J.

Optionally, referring to FIG. 7, the display apparatus also include a source driving circuit 03 and a display control circuit 04. The voltage collection port J is set in the display control circuit 04. In particular, the display control circuit 04 is respectively connected to the sampling circuit 10 and the source driving circuit 03. The display control circuit 04 is configured to adjust a gamma correction voltage inputted to the source driving circuit 03 based on the voltage signal sampled by the sampling circuit 10. The source driving circuit 03 is configured to further adjust the data signal to be inputted in respective columns of pixels based on the gamma correction voltage.

Figure 8:
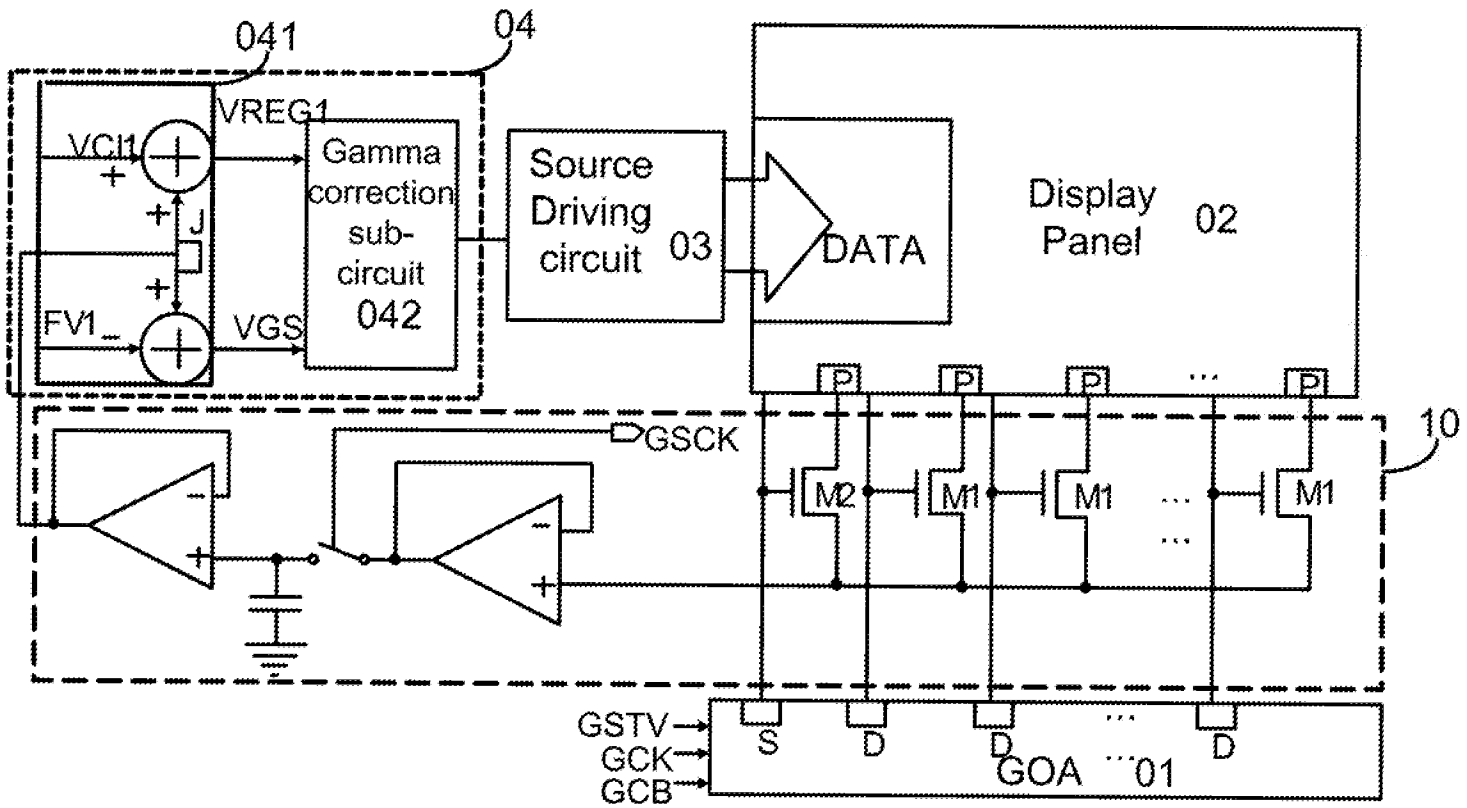
FIG. 8 is a block diagram of a display apparatus according to another embodiment of the present disclosure.

FIG. 8 is a block diagram of a display apparatus according to another embodiment of the present disclosure. Referring to FIG. 8, the display control circuit 04 can include an adder sub-circuit 041 and a gamma correction sub-circuit 042. In an embodiment, the adder sub-circuit 041 is respectively connected with the sampling circuit 10 and the gamma correction sub-circuit 042. The adder sub-circuit 041 is configured to calculate a first reference voltage VREG1 based on a preset first base voltage FV1 and a received voltage signal from the sampling circuit 10. Further, the adder sub-circuit 041 is configured to calculate a second reference voltage VGS based on a preset second base voltage VCI1 and the received voltage signal from the sampling circuit 10.

For example, when a received voltage is an anode voltage ELVDD sampled at an anode of OLED device in the display panel, the first reference voltage VREG1 is calculated to be:

VREG1=ELVDD−FV1, and the second reference voltage VGS is calculated to be: VGS=ELVDD−VCI1.

Additionally, referring to FIG. 8, the gamma correction sub-circuit 042 is connected to the source driving circuit 03. The gamma correction sub-circuit 042 is configured to calculate the gamma correction voltage based on the first reference voltage VREG1 and the second reference voltage VGA. The gamma correction sub-circuit 042 also is configured to input the gamma correction voltage to the source driving circuit 03. The source driving circuit 03 is configured to further adjust a range of a data signal inputted to respective columns of pixels in the display panel 02, thereby effectively improving display performance of the display panel 02.

In an implementation, when the sampled voltage signal by the sampling circuit is an anode voltage, the source driving circuit 03 may provide a data voltage Vdata to each pixel in the display panel. A driving current $I_{OLED}$ associated with this data voltage can be expressed as: $I_{OLED} \propto k \times (ELVDD - Vdata)^2$. Here, $k=(W/2L) \cdot C_{ox} \cdot \mu$, μ is a carrier mobility in the display panel, Cox is a capacitor associated with gate-insulator, W/L is a channel width to length ratio of the driving transistor, and ELVDD is an anode voltage at the anode of the (OLED) pixel. As seen in the expression of the driving current $I_{OLED}$ both the anode voltage ELVDD and the data voltage Vdata will affect the driving current. During the driving operation of the display panel, the anode voltage ELVDD is easily disturbed to affect stability of the driving current. By sampling the anode voltage in substantially real time through the sampling circuit provided in this disclosure, the data voltage that is adjusted first based on the anode voltage sampled from the display panel before being inputted into the respective columns of pixels in the display panel. Therefore, the driving current determined by the adjusted data voltage can be more stable to improve display performance of the display panel. Moreover, because each of the multiple sampling sub-circuits in the sampling circuit can be connected to a separate voltage sampling point associated with different pixel in the display panel, the sampling sub-circuit can transfer the sampled voltage signal to a voltage collection port under control of gate-driving signal from a gate-driving output terminal of the GOA circuit. The display apparatus then can use the sampled voltage signal to improve the display performance.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A display apparatus comprising:

a display panel;

a gate-driver-on-array (GOA) circuit for driving the display panel;

a sampling circuit comprising multiple sampling sub-circuits;

a source driving circuit and a display control circuit wherein a respective one of the multiple sampling sub-circuits comprises an output terminal coupled to a voltage collection port, a control terminal coupled to at least one gate-driving output terminal of a gate-driver-on-array (GOA) circuit for driving the display apparatus, and an input terminal coupled separately to a respective one of a plurality of voltage sampling points in the display apparatus; and the respective one of the multiple sampling sub-circuits is configured to collect a voltage signal at the input terminal and transfer the voltage signal via the output terminal to the voltage collection port when the gate-driving output terminal outputs a gate-driving signal;

the GOA circuit respectively is connected to a respective row of pixels in the display panel;

the sampling circuit respectively is connected to the GOA circuit and to the display panel, is configured to transfer a voltage signal collected from the display panel to the voltage collection port, the voltage collection port being set in the display control circuit the display control circuit respectively is connected to the sampling circuit and to the source driving circuit, and is configured to adjust a gamma correction voltage as an input into the source driving circuit based on the voltage signal transferred to the voltage collection port; and the source driving circuit respectively is connected to a respective column of pixels in the display panel, and is configured to adjust a data signal as an input to the respective column of pixels based on the gamma correction voltage;

wherein the display control circuit comprises an adder sub-circuit and a gamma-correction sub-circuit;

the adder sub-circuit is respectively connected to the sampling circuit and the gamma-correction sub-circuit;

the adder sub-circuit is configured to perform a first calculation based on a preset first base voltage and the voltage signal at the voltage collection port to obtain a first reference voltage, and to perform a second calculation based on a preset second base voltage and the voltage signal at the voltage collection port to obtain a second reference voltage;

the gamma-correction sub-circuit is connected to the source driving circuit; and the gamma-correction sub-circuit is configured to perform a third calculation based on the first reference voltage and the second reference voltage to obtain the gamma correction voltage and input the gamma correction voltage to the source driving circuit.

2. The display apparatus of claim 1, wherein the respective one of the plurality of voltage sampling points is in a region of a respective one of a plurality of pixels of the display apparatus, the respective one of the plurality of voltage sampling points being driven by the gate-driving signal from the gate-driving output terminal of the GOA circuit.

3. The display apparatus of claim 1, wherein the display apparatus is an organic light-emitting diode display and the plurality of voltage sampling points are anodes of a plurality of light-emitting diodes in a plurality of pixels.

4. The display apparatus of claim 1, further comprising:

a voltage-retaining sub-circuit having a first terminal coupled to the output terminal of the respective one of the multiple sampling sub-circuits, a second terminal coupled to the voltage collection port, wherein the voltage-retaining sub-circuit is configured, during a current sampling period when no voltage signal is outputted from the output terminal of the respective one of the multiple sampling sub-circuits, to retain a voltage level at the voltage collection port same as the voltage signal transferred to the voltage collection port in a last sampling period.

5. The display apparatus of claim 1, wherein the respective one of the multiple sampling sub-circuits comprises a first transistor having a gate electrode coupled to a gate-driving output terminal of the GOA circuit, a first electrode coupled to a voltage sampling point, and a second electrode coupled to the voltage collection port.

6. The display apparatus of claim 4, wherein the voltage-retaining sub-circuit comprises a capacitor coupled with a switch;

wherein the switch comprises a control terminal coupled to a clock signal terminal, an input terminal coupled to the output terminal of the respective one of the multiple sampling sub-circuits, and an output terminal coupled to a first terminal of the capacitor and the voltage collection port;

the capacitor comprises a second terminal coupled to a pull-down power supply terminal; and the switch is configured to control a connection of the output terminal of the respective one of the multiple sampling sub-circuits to the voltage collection port when a clock control signal provided at the clock signal terminal is an effective turn-on voltage level, or a disconnection of the output terminal of the respective one of the multiple sampling sub-circuits to the voltage collection port when a clock signal provided at the clock signal terminal is an effective turn-off voltage level.

7. The display apparatus of claim 6, wherein the voltage-retaining sub-circuit further comprises a first impedance converter having a first terminal coupled the output terminal of the respective one of the multiple sampling sub-circuits and a second terminal coupled to the input terminal of the switch.

8. The display apparatus of claim 6, wherein the voltage-retaining sub-circuit further comprises a second impedance converter having a first terminal coupled to the output terminal of the switch and a second terminal coupled to the voltage collection port.

9. The display apparatus of claim 6, wherein the voltage-retaining sub-circuit further comprises:

a first impedance converter having a first terminal coupled the output terminal of the respective one of the multiple sampling sub-circuits and a second terminal coupled to the input terminal of the switch; and a second impedance converter having a first terminal coupled to the output terminal of the switch and a second terminal coupled to the voltage collection port.

10. The display apparatus of claim 1, further comprises a second transistor having a gate electrode coupled to a starting gate-driving output terminal of the GOA circuit, a first electrode coupled to a voltage sampling point in the display apparatus, and a second electrode coupled to the voltage collection port;

wherein the starting gate-driving output terminal is configured to output a driving signal before a first gate-driving output terminal of the GOA circuit outputs a first gate-driving signal.

11. The display apparatus of claim 1, wherein a total number of the multiple sampling sub-circuits is equal to a total number of gate-driving output terminals in the GOA circuit; and control terminals of the multiple sampling sub-circuits are respectively connected to gate-driving output terminals of the GOA circuit.

12. The display apparatus of claim 1, wherein a total number of the multiple sampling sub-circuits is smaller than a total number of gate-driving output terminals in the GOA circuit; and the multiple sampling sub-circuits comprises at least one first sampling sub-circuits, an output terminal of a respective one of the at least one first sampling sub-circuits being connected to multiple gate-driving output terminals of the GOA circuit.

13. The sampling circuit of claim 1, wherein the GOA circuit is respectively coupled to a first clock signal terminal and a second clock signal terminal; the GOA circuit is configured to control a timing sequence of a respective gate-driving output terminal to output a corresponding gate-driving signal under control of a first clock signal provided to the first clock signal terminal and a second clock signal provided to the second clock signal terminal; and the clock control signal is at an ineffective turn-off voltage level when both the first clock signal and the second clock signal are at an ineffective turn-off voltage level; wherein alternatively the clock control signal is at an effective turn-on voltage level when at least one of the first clock signal and the second clock signal is at an effective turn-on voltage level.

* * * * *